United States Patent [19]

Hsiao

[11] Patent Number: 4,926,721

[45] Date of Patent: May 22, 1990

[54] MULTIPURPOSE HAND TOOL STRUCTURE

[76] Inventor: K. H. Hsiao, No. 4, Lane 11, Tzu Chiang St., Tu Cheng Shiang, Taichung Shien, Taiwan

[21] Appl. No.: 372,762

[22] Filed: Jun. 29, 1989

[51] Int. Cl.[5] ..... B25G 1/08

[52] U.S. Cl. ..... 81/177.4; 81/124.4; 81/439

[58] Field of Search ..... 81/177.4, 490, 124.4, 81/124.5, 437–439

[56] References Cited

U.S. PATENT DOCUMENTS

| | | | |
|---|---|---|---|
| 939,079 | 11/1909 | Peck | 81/490 |
| 2,301,945 | 11/1942 | Green | 81/177.4 X |
| 4,267,315 | 12/1986 | Lin | 81/490 X |

*Primary Examiner*—D. S. Meislin

*Attorney, Agent, or Firm*—Bacon & Thomas

[57] ABSTRACT

A concealed and built-up type multipurpose hand tool structure which includes a hollow and T-shaped handle for storing a variety of sockets, having middle through-holes to receive therein a variety of hexagonal wrenches or driver heads or other cylindrical tool parts.

6 Claims, 3 Drawing Sheets

MULTIPURPOSE HAND TOOL STRUCTURE

BACKGROUND OF THE INVENTION

The present invention is related to a concealed and built-up type multipurpose hand tool structure which includes a variety of sockets set in a hollow T-handle, wherein the sockets have middle through-holes to provide tubular receiving spaces for setting therein of a variety of hexagonal wrenches or drivers so as to minimize space consumption.

Conventional built-up type hand tools normally include a hollow handle to provide a receiving space for setting therein of tool elements. Among regular hand tools, hexagonal wrenches sockets are more space consuming. Therefore, in regular built-up type hand tools, hexagonal wrenches or sockets are normally packed separately or a limited number of sockets are allowed to set in a hollow tool handle while the cylindrical elements must be removed from the hollow tool handle.

The main object of the present invention is to overcome the said disadvantage of the known built-up type handle tools, and to provide an arrangement in which a variety of cylindrical tool elements are respectively received in a variety of sockets and, both the variety of cylindrical tool elements and sockets are further received in a hollow T-handle.

The construction, features and advantages of the present invention will be best understood from the following description of a specific embodiment thereof when read in connection with the accompanying drawings.

DETAILED DESCRIPTION OF THE PREFERRED EMBODIMENT

Figure 1:
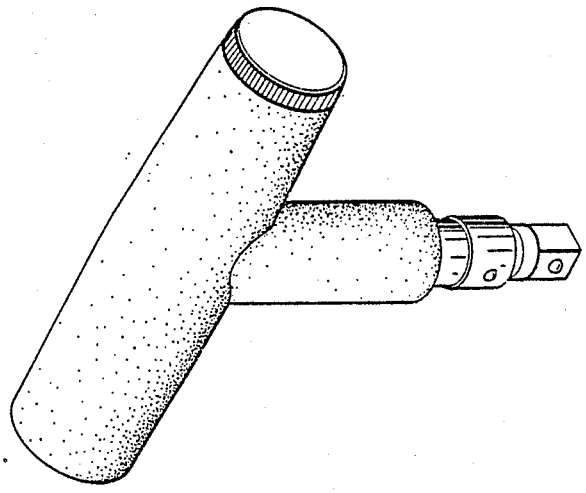
FIG. 1 is a perspective view of the present invention shown with the tool parts concealed in the T-handle.
Figure 2:
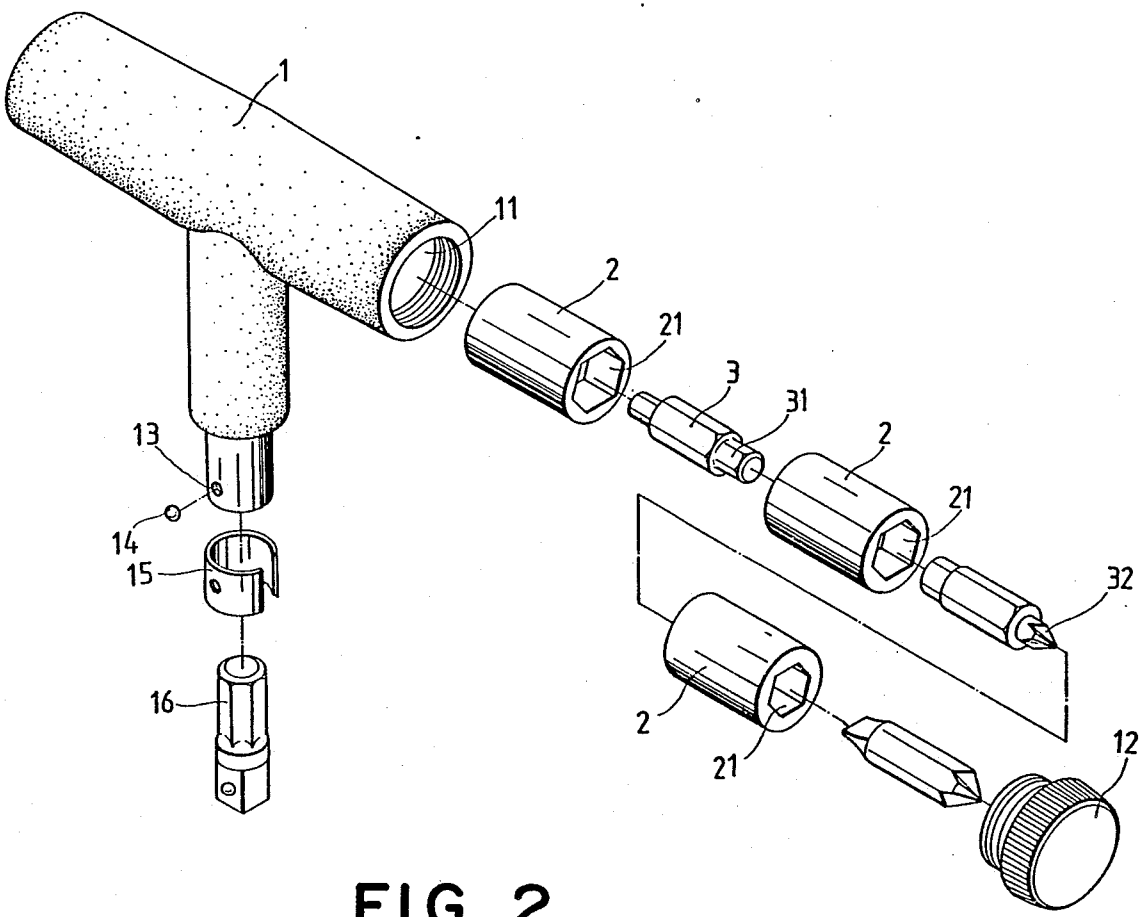
FIG. 2 is a perspective exploded view of the present invention.

With reference to FIG. 2, there is a concealed and built-up type multipurpose hand tool structure constructed according to the present invention, which includes a T-handle 1 having a hollow handle portion 11 at the top. The hollow handle portion 11 includes an inner chamber for receiving tool parts. A cap 12 is connected to the hollow handle portion 11 at one end thereof by means of a screw joint, to return the tool parts therein. A through-hole 13 is made on the bottom end of the T-handle 1 for receiving therein a steel ball 14 to control the positioning of a C-ring 15 which is mounted thereon, and the positioning of the tool part which is connected thereto.

Figures 3A, 3B, 3C:
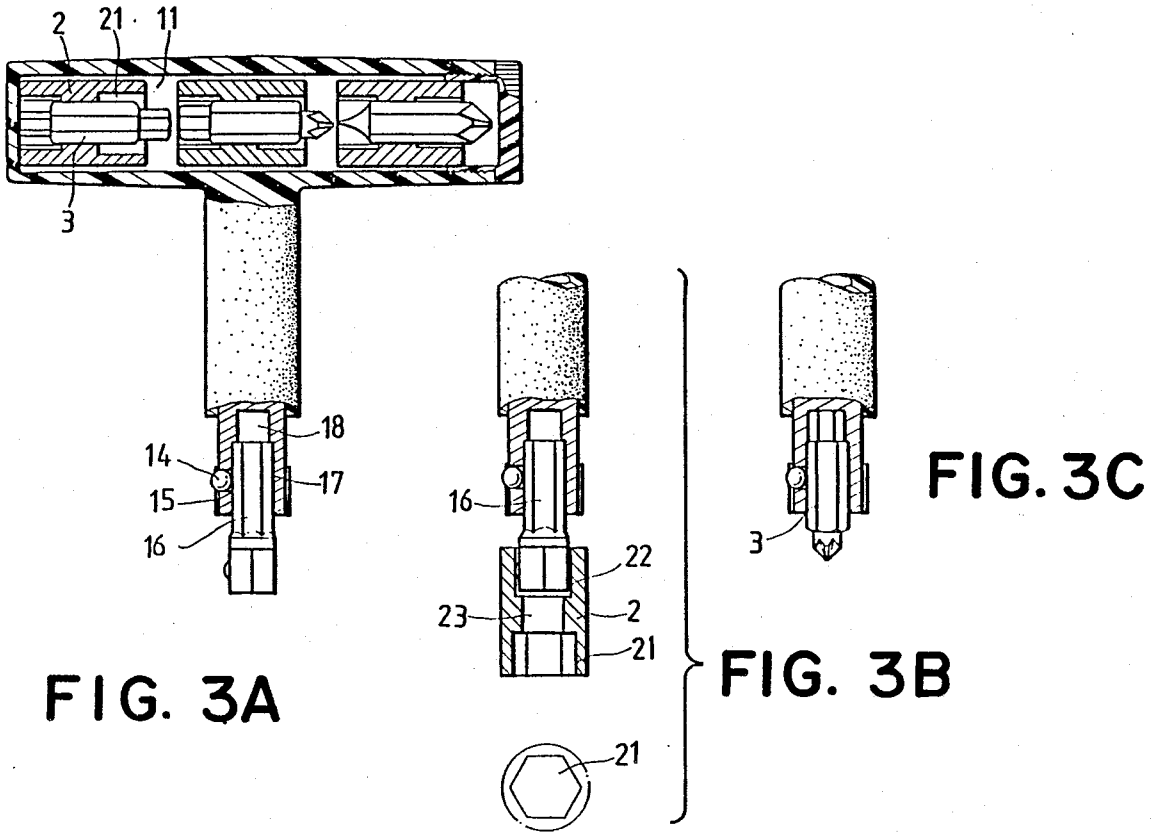
FIG. 3 are partly sectional drawings of the present invention, illustrating the arrangement of the tool parts in the T-handle and the installation of related parts for use.

With reference to FIG. 3, the T-handle 1 includes a hexagonal boring bore 17 set in the bottom end of its vertical leg for connection thereto of a socket connector 16, which socket connector 16 includes an hexagonal end inserted into the hexagonal boring bore 17 of the T-handle 1, and has a square end opposite to the hexagonal end for alternate connection to a of a variety of sockets 2. The sockets 2 are each provided at one end, with a common square hole 22 of a desired fixed size for insertion therein of the square end of the socket connector 16 during the connection, and a hexagonal hole 21 of a desired size at the other end for driving a variety of corresponding bolts or screw nuts.

When the socket connector 16 is removed from the T-handle, any tool parts 3 having a hexagonal cylinder structure of proper size may be alternatively inserted through the hexagonal hole 17 into the hole 18 to form a specific hand tool for a specific operation. According to the present invention, the hole 18 is set at the inner side of the hexagonal hole 17, the latter having an inner diameter slightly larger than the outer diameter of the tool parts 3 to facilitate the alternative connection of the tool parts. The tool parts 3 are each provided with both ends thereof respectively designed for specific use purposes. Hole 18 has a smaller inner diameter than hole 17 for receiving a corresponding reduced diameter end of each tool part 3.

As described above and illustrated in the annexed drawings, a hand tool constructed according to the present invention may provide at least 9 functions (including three sockets 2 and three hexagonal wrenches 31 of different sizes, and three screw drivers 32 of different shapes). By extending the size of the hollow transverse rod 11 of the T-handle 1, a few more tool parts may be received therein to extend the applicability of the present invention.

The main feature of the present invention is to fully utilize the limited inner space of the T-handle 1. According to the present invention, the sockets 2 each includes a middle through-hole 23 (as shown in FIG. 3) respectively communicating with the front hexagonal hole 21 and the rear square hole 22, which middle through-hole 23 has an inner diameter slightly larger than the outer diameter of the cylindrical tool parts 3. As shown in FIG. 3, when not in use, the tool parts 3 may be respectively received in the sockets 2 to be set in the hollow transverse rod 11 of the T-handle 1.

In conclusion, as described above, the present invention is to provide such a concealed and built-up type multipurpose hand tool having numerous features each of which tends to make the structure more compact for convenient storage and more practical in use.

As indicated above, the structure herein may be variously embodied. Recognizing various modifications will be apparent, the scope hereof shall be deemed to be defined by the claims as set forth below.

I claim:

1. A multi-purpose hand tool structure comprising:

(a) a hollow handle portion for storing a plurality of sockets therein;

(b) a plurality of sockets for storage within the hollow handle portion;

(c) a socket connector (d) each socket including a first hole at one end thereof for engagement with said socket connector, a second hole at another end thereof for engaging a fastener head, and a middle through hole extending between the first and second holes, each middle through hole having an inner diameter sized to receive a cylindrical tool part therein;

(e) a cylindrical tool part disposable within the middle through hole of each socket, wherein the sockets and their corresponding tool parts may collectively be stored within the hollow handle portion; and (f) engaging means for detachably selectively securing said socket connector or one of said tool parts to the tool structure.

2. The tool structure of claim 1 wherein each socket and tool part are dimensioned so that only a single tool part is receivable in each socket.

3. The tool structure of claim 1 wherein the middle through hole of each socket has an inner diameter that is slightly larger than the largest outer diameter of any of the tool parts, so that any tool part may be received in the middle through hole of any socket.

4. The tool structure of claim 1 wherein the middle through hole of each socket is of a substantially round configuration, the first and second holes being each of a hexagonal configuration, and the middle through hole communicating with the first and second holes.

5. The tool structure of claim 1 wherein the handle portion is of a substantially T-shaped configuration and including a hollow horizontal leg for storing the sockets and tool parts and a vertical leg including a lower end, said engaging means located at said lower end.

6. The tool structure of claim 5 wherein the lower end includes an outer passageway and an inner passageway, the outer passageway having an inner diameter that is larger than the inner diameter of the inner passageway, and the detachable engaging means includes a steel ball extending through the wall of the lower end into the outer passageway and a C-ring surrounding the lower end for maintaining the ball in position.

* * * * *

UNITED STATES PATENT AND TRADEMARK OFFICE

CERTIFICATE OF CORRECTION

PATENT NO. : 4,926,721

DATED : May 22, 1990

INVENTOR(S) : K.H. Hsiao

It is certified that error appears in the above-identified patent and that said Letters Patent is hereby corrected as shown below:

On the title page:

In the Inventor's Address:

Delete "Taichung Shien, Taiwan", and insert therefor:

--Teipei Shien, Taiwan,

Signed and Sealed this

Twenty-seventh Day of August, 1991

*Attest:*

HARRY F. MANBECK, JR.

*Attesting Officer*

*Commissioner of Patents and Trademarks*